US011882873B2

(12) United States Patent
Liu

(10) Patent No.: US 11,882,873 B2
(45) Date of Patent: Jan. 30, 2024

(54) TOBACCO FEEDING DEVICE AND ELECTRONIC HOOKAH COMPRISING THE SAME

(71) Applicant: Shenzhen Eigate Technology Co., Ltd., Shenzhen (CN)

(72) Inventor: Tuanfang Liu, Shenzhen (CN)

(73) Assignee: ASPIRE NORTH AMERICA LLC

( * ) Notice: Subject to any disclaimer, the term of this patent is extended or adjusted under 35 U.S.C. 154(b) by 284 days.

(21) Appl. No.: 17/120,255

(22) Filed: Dec. 13, 2020

(65) Prior Publication Data

US 2021/0401032 A1 Dec. 30, 2021

(30) Foreign Application Priority Data

Jun. 29, 2020 (CN) ..... 202010607062.4
Jun. 29, 2020 (CN) ..... 202021227128.9

(51) Int. Cl.
*A24F 1/30* (2006.01)
*A24F 1/08* (2006.01)
*A24F 1/32* (2006.01)

(52) U.S. Cl.
CPC ..... *A24F 1/30* (2013.01); *A24F 1/08* (2013.01); *A24F 1/32* (2013.01)

(58) Field of Classification Search
CPC ..... A24F 1/30; A24F 1/32; A24F 1/08
See application file for complete search history.

(56) References Cited

U.S. PATENT DOCUMENTS 3,605,758 A * 9/1971 Patterson ..... A24F 1/00 131/183
2009/0258117 A1* 10/2009 Lee ..... A24F 1/32 426/514
2019/0307171 A1* 10/2019 Kane ..... H05B 3/46

* cited by examiner

*Primary Examiner* — Philip Y Louie
*Assistant Examiner* — Miles A Simpson
(74) *Attorney, Agent, or Firm* — MATTHIAS SCHOLL P.C.; Matthias Scholl

(57) ABSTRACT

A tobacco feeding device incudes a glass tube, a push rod, and a piston. The piston is movable along the inner wall of the glass tube. The push rod includes an air passage. The glass tube includes a feeding inlet. When the piston moves along the inner wall of the glass tube, a gap between the feeding inlet and the piston is exposed and a tobacco material is added to the tobacco feeding device. When in use, smoke produced by the tobacco material circulates in the air passage.

15 Claims, 5 Drawing Sheets

TOBACCO FEEDING DEVICE AND ELECTRONIC HOOKAH COMPRISING THE SAME

CROSS-REFERENCE TO RELAYED APPLICATIONS

Pursuant to 35 U.S.C. § 119 and the Paris Convention Treaty, this application claims foreign priority to Chinese Patent Application No. 202010607062.4 filed on Jun. 29, 2020, and to Chinese Patent Application No. 202021227128.9 filed on Jun. 29, 2020. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, MA 02142.

BACKGROUND

The disclosure relates to an electronic hookah.

Conventionally, the tobacco material is added to an electronic hookah once and for all. When the electronic hookah breaks down, the tobacco material is wasted.

SUMMARY

The disclosure provides a tobacco feeding device, comprising a glass tube, a push rod, and a piston; the piston is movable along an inner wall of the glass tube; the push rod comprises an air passage; the glass tube comprises a feeding inlet; when the piston moves along the inner wall of the glass tube, a gap between the feeding inlet and the piston is exposed and a tobacco material is added to the tobacco feeding device; when in use, smoke produced by the tobacco material circulates in the air passage.

In a class of this embodiment, the tobacco feeding device further comprises an assistant push rod; the piston is fixedly connected to one end of the push rod; the assistant push rod sleeves the push rod; the piston is movable along the inner wall of the glass tube towards the feeding inlet under the action of the assistant push rod.

In a class of this embodiment, the tobacco feeding device further comprises a silicone ring disposed between the assistant push rod and the push rod; and under the action of frictional force, the movement of the assistant push rod drives the push rod to move.

In a class of this embodiment, the tobacco feeding device further comprises a cylinder and a press button; the assistant push rod is disposed in the cylinder; the cylinder comprises a slideway and the press button is disposed in the slideway and contacts a top end of the assistant push rod; the movement of the press button in the slideway drives the assistant push rod to move.

In a class of this embodiment, the tobacco feeding device further comprises a location pin disposed on the top end of the assistant push rod; an inner wall of the cylinder comprises a continuous groove corresponding to the location pin.

In a class of this embodiment, the piston is a hollow structure comprising an air channel and an end face, and the end face comprises a plurality of evenly distributed through holes.

The disclosure also provides a smoke filter, comprising a rotating shaft, a glass tube for water storage, and a fixed seat for fixing the rotating shaft; the rotating shaft is disposed in the glass tube and on the fixed seat, and is rotatable with respect to the fixed seat; and the rotating shaft comprises a heavy side and a light side; each side comprises an air inlet; when placed horizontally, the heavy side is downward and the light side is upward.

In a class of this embodiment, the rotating shaft further comprises two air passages isolated from each other and communicating with the air inlets of the heavy side and the light side, respectively; when the glass tube contains water, smoke filtered by the water enters the air passage of the light side; and unfiltered smoke enters the air passage of the heavy side.

In a class of this embodiment, the fixed seat comprises an inner air passage; the inner air passage communicates with the air passage of the heavy side of the rotating shaft; the air passage of the light side of the rotating shaft communicates with a mouthpiece.

In a class of this embodiment, the smoke filter further comprises a long glass tube; the rotating shaft is in the vicinity of the mouthpiece; one opening of the long glass tube communicating with the air inlet of the heavy side, and the other opening of the long glass tube is disposed on a bottom end of the glass tube away from the mouthpiece In a class of this embodiment, a part of the push rod is disposed in the fixed seat and communicates with the inner air passage of the fixed seat.

In another aspect, provided is an electronic hookah, comprising a tobacco feeding device of claim and a smoke filter; the smoke filter comprises a rotating shaft, a glass tube for water storage, and a fixed seat for fixing the rotating shaft; the rotating shaft is disposed in the glass tube and on the fixed seat, and is rotatable with respect to the fixed seat; and the rotating shaft comprises a heavy side and a light side; each side comprises an air inlet; when placed horizontally, the heavy side is downward and the light side is upward.

DETAILED DESCRIPTION

To further illustrate, embodiments detailing an electronic hookah are described below. It should be noted that the following embodiments are intended to describe and not to limit the disclosure.

Figure 1:
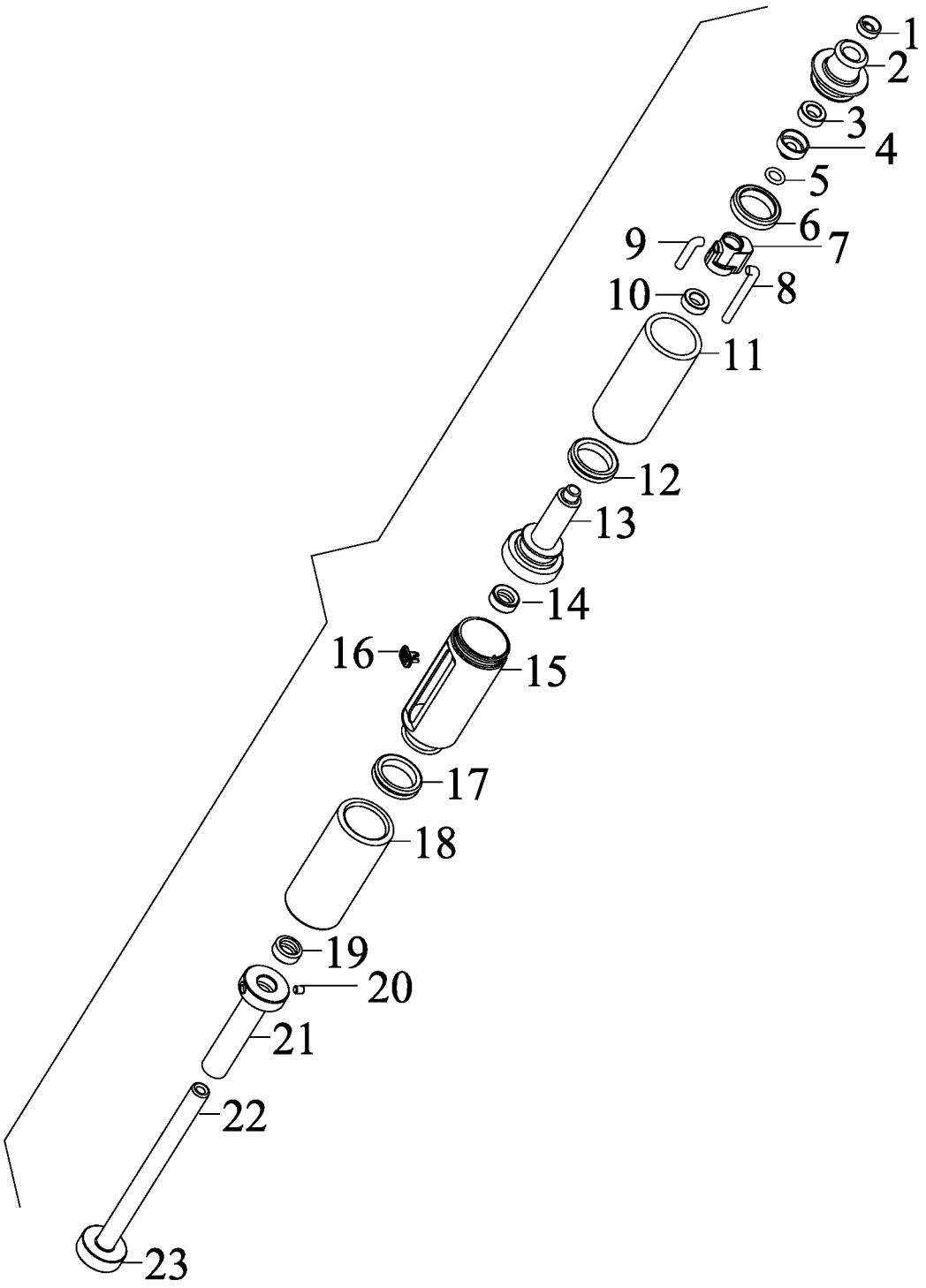
FIG. 1 is an exploded view of an electronic hookah in accordance with one embodiment of the disclosure.
Figure 2:
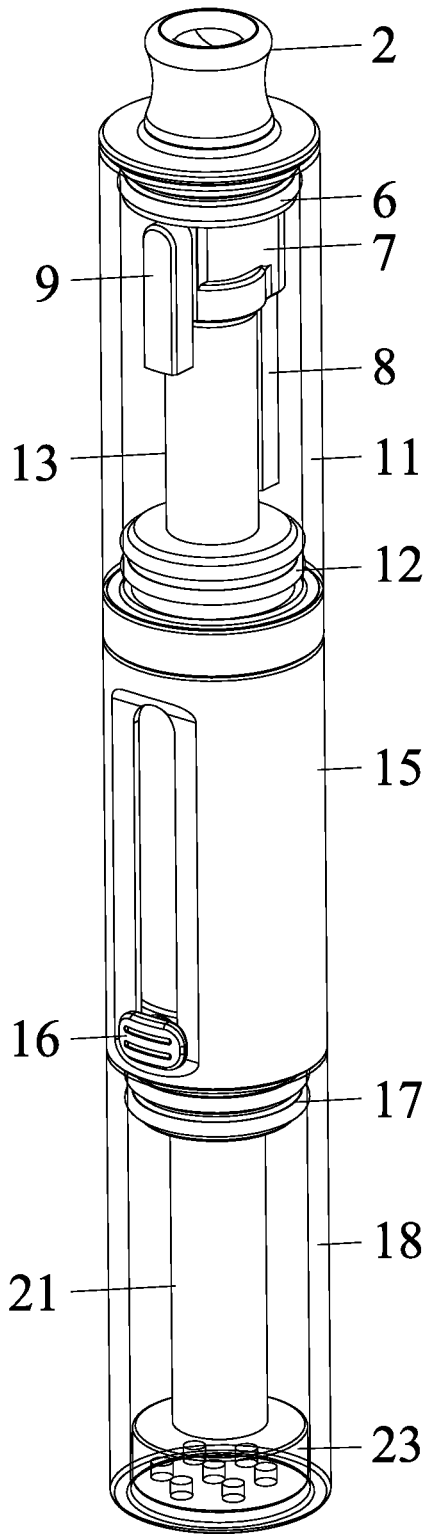
FIG. 2 is a schematic diagram of an electronic hookah in accordance with one embodiment of the disclosure.
Figure 3:
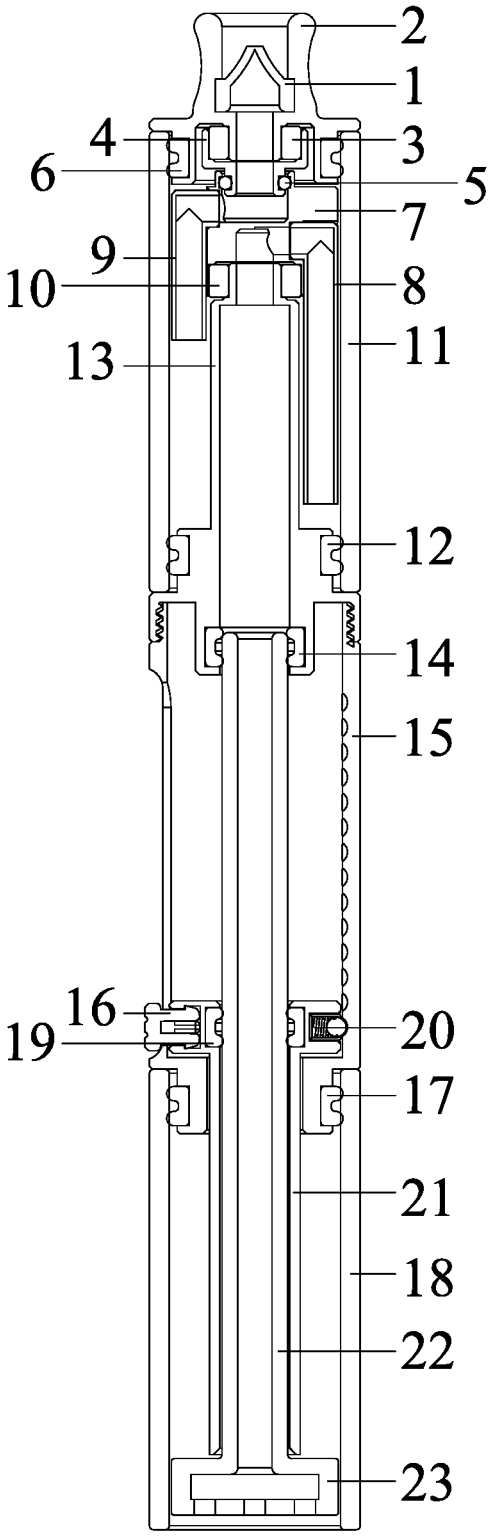
FIG. 3 is a sectional view of an electronic hookah in accordance with one embodiment of the disclosure.
Figure 4:
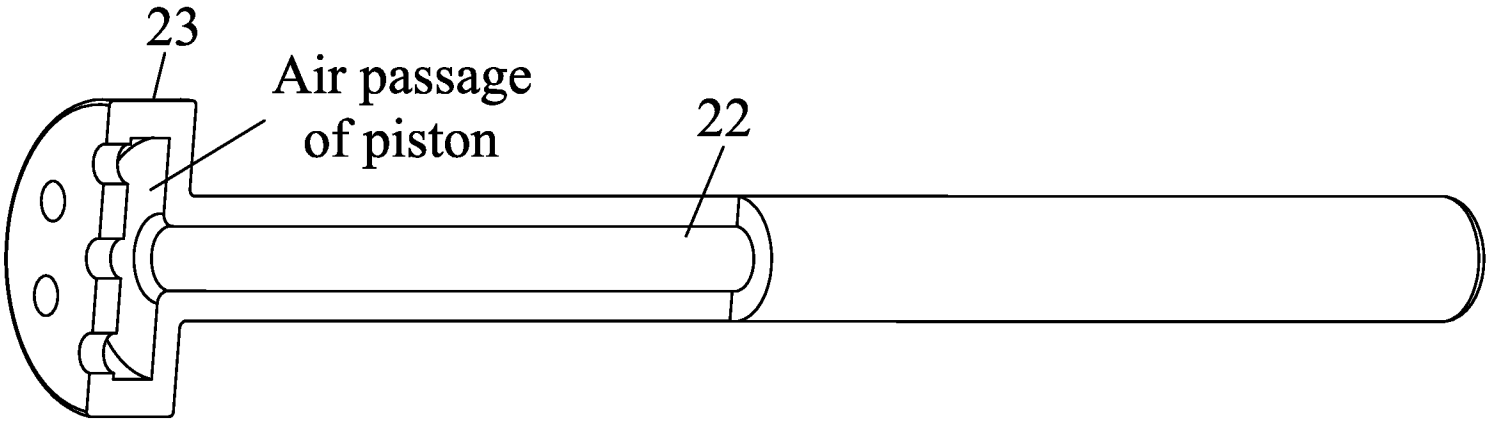
FIG. 4 is a schematic diagram of an air passage of a piston of an electronic hookah in accordance with one embodiment of the disclosure.
Figure 5:
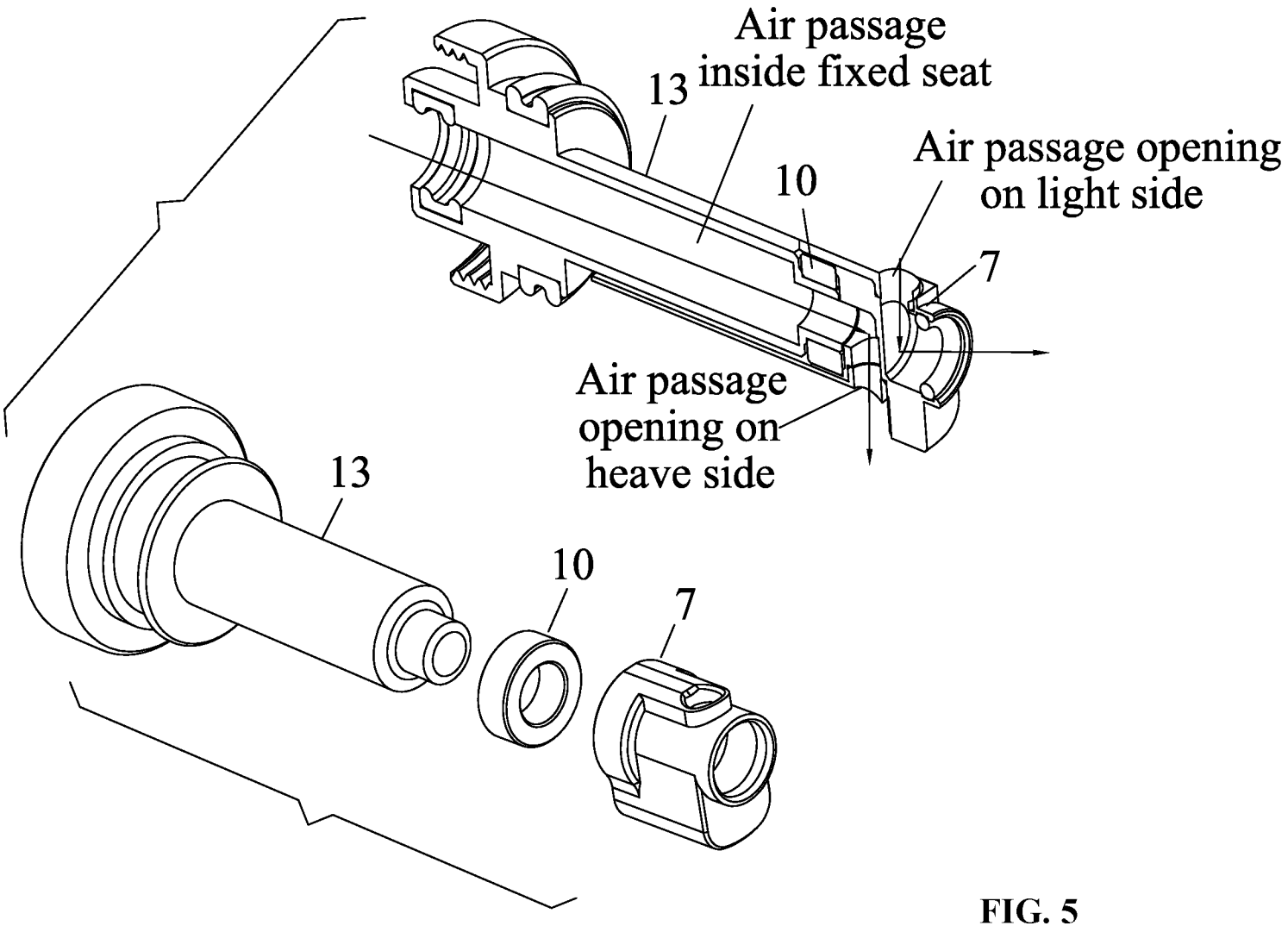
FIG. 5 is a schematic diagram of a fixed seat and an air passage of an electronic hookah in accordance with one embodiment of the disclosure.

As shown in FIGS. 1-5, the disclosure provides an electronic hookah comprising a unidirectional silicone ring 1, a mouthpiece 2, an upper bearing 3, a bearing cover 4, a first seal ring 5 sealing the bearing cover 4, an upper seal ring 6, a rotating shaft 7, a first glass tube 8, a second glass tube 9 shorter than the first glass tube, a lower bearing 10, a third glass tube 11 for water storage, a lower seal ring 12, a fixed seat 13 for fixing the rotating shaft, a second seal ring 14, a cylinder 15, a press button 16, a fourth glass tube 18, a third seal ring 17 sealing the fourth glass tube, a silicone ring 19, a location pin 20, an assistant push rod 21, a push rod 22, and a piston 23.

The silicone ring 19 is disposed between the assistant push rod 21 and the push rod 22 to mobilize the push rod 22. The location pin 20 disposed on the top end of the assistant push rod 21 to control a moving distance of the assistant push rod 21 in the cylinder 15. The assistant push rod 21 is disposed in the cylinder 15 and moves in the cylinder 15 to drive the push rod 22 to move. The cylinder 15 comprises a slideway and the press button 16 is disposed in the slideway and contacts the top end of the assistant push rod 21. The movement of the press button 16 in the slideway drives the assistant push rod 21 to move. The push rod 22 runs through the assistant push rod 21 from the bottom opening of the cylinder 15 and the top end of the push rod is exposed out of the assistant push rod 21. The third seal ring 17 is disposed on the bottom end of the cylinder 15 to fix and seal the fourth glass tube 18. The rotating shaft 7 is disposed on the fixed seat 13 and comprises a heavy side and a light side. Each side comprises an air inlet. When placed horizontally, the heavy side is downward and the light side is upward. The rotating shaft 17 further comprises two air passages isolated from each other and communicating with the air inlets of the heavy side and the light side, respectively. The second glass tube 9 communicates with the air inlet of the light side, and smoke filtered in water flows into the air passage of the light side via the air inlet and flows to the mouthpiece for user's inhaling. In certain embodiments, the second glass tube 9 is omitted, the smoke filtered in water directly enters the air passage of the light side via the air inlet and flows to the mouthpiece 2. The first glass tube 8 communicates with the air inlet of the heavy side, and the smoke enters the water via the first glass tube and is filtered. The lower bearing 10 is disposed in the bottom end of the rotating shaft 7. The top end of the fixed seat 13 is fixed on the lower bearing 10. The fixed seat 13 comprises an inner air passage. The first glass tube 8 communicates with the air passage of the heavy side of the rotating shaft 7 via the inner air passage. The lower seal ring 12 is disposed around the fixed seat 13 to seal and fix the third glass tube 11. The third glass tube 11 is disposed on the fixed seat 13 and lower seal ring 12 is disposed between the third glass tube 11 and the fixed seat 13. The second seal ring 14 is disposed in the fixed seat 13 to fill the gap between the push rod 22 and the fixed seat 13. The fixed seat 13 is in threaded connection to the cylinder 15 and the top end of the push rod 22 is extended into the fixed seat 13. The unidirectional silicone ring 1 is disposed on the mouthpiece 2 to prevent air from flowing into the mouthpiece 2. The first seal ring 5 is disposed on the bearing cover 4. The upper bearing 3 is disposed in the bearing cover 4 and the bearing cover 4 is disposed on the bottom end of the mouthpiece 2. The upper seal ring 6 is disposed on the bottom end of the mouthpiece 2 and seals the top opening of the third glass tube 11. The mouthpiece 2 is disposed on the top opening of the third glass tube 11 and communicates with the air passage of the light side of the rotating shaft 7. The piston 23 is fixedly connected to the push rod 22. The piston 23 is a hollow structure comprising an air channel and an end face, and the end face comprises three evenly distributed through holes.

The following advantages are associated with the electronic hookah of the disclosure:

1. The electronic hookah comprises the movable piston so that the amount of the tobacco material is adjustable.
2. The electronic hookah can filter produced smoke, thus improving the taste of the smoke.
3. The electronic hookah is compact and easy to carry.

It will be obvious to those skilled in the art that changes and modifications may be made, and therefore, the aim in the appended claims is to cover all such changes and modifications.

What is claimed is:

1. An electronic hookah, comprising a tobacco feeding device, a mouthpiece, and a smoke filter, wherein:

the smoke filter comprises a first glass tube, a rotating shaft, a third glass tube for water storage, and a fixed seat for fixing the rotating shaft;

the mouthpiece is connected with the third glass tube, the tobacco feeding device comprises a fourth glass tube, a push rod, and a piston; the piston being movable along an inner wall of the fourth glass tube, the push rod comprising a first smoke passage, the fourth glass tube comprising a feeding inlet when the piston moves along the inner wall of the fourth glass tube, a gap between the feeding inlet and the piston is formed and tobacco material is added to the tobacco feeding device;

the rotating shaft is disposed in the third glass tube and on the fixed seat, and is rotatable with respect to the fixed seat;

the rotating shaft comprises a first hollow columnar part as a second smoke passage, and a second hollow columnar part as a third smoke passage;

the first hollow columnar part is heavier than the second hollow columnar part, and when placed horizontally, the first hollow columnar part is downward and the second hollow columnar part is upward;

the first hollow columnar part and the second hollow columnar part are separate from each other;

the first hollow columnar part comprises a first smoke inlet, and the second hollow columnar part comprises a second smoke inlet;

the fixed seat comprises an inner smoke passage, and the inner smoke passage communicates with the second smoke passage;

the third smoke passage communicates with the mouthpiece; and one end of the first glass tube is connected to the first smoke inlet of the first hollow columnar part, and another end of the first glass tube is disposed above an inner bottom surface of the third glass tube.

2. The electronic hookah of claim 1, wherein the smoke filter further comprises a second glass tube; the second glass tube is connected to the second smoke inlet of the second hollow columnar part.

3. The electronic hookah of claim 1, wherein a part of the push rod is disposed in the fixed seat, and communicates with the inner smoke passage of the fixed seat.

4. The electronic hookah of claim 1, wherein the tobacco feeding device further comprises an assistant push rod; the piston is fixedly connected to one end of the push rod; the assistant push rod sleeves the push rod; the piston is movable along the inner wall of the fourth glass tube towards the feeding inlet under the action of the assistant push rod.

5. The electronic hookah of claim 4, wherein the tobacco feeding device further comprises a silicone ring disposed between the assistant push rod and the push rod; under the action of frictional force, the movement of the assistant push rod drives the push rod to move.

6. The electronic hookah of claim 5, wherein the tobacco feeding device further comprises a cylinder and a press button; the assistant push rod is disposed in the cylinder; the cylinder comprises a slideway and the press button is disposed in the slideway and contacts a top end of the assistant push rod; the movement of the press button in the slideway drives the assistant push rod to move.

7. The electronic hookah of claim 6, wherein the tobacco feeding device further comprises a location pin disposed on the top end of the assistant push rod; an inner wall of the cylinder comprises a continuous groove matching with the location pin.

8. The electronic hookah of claim 7, wherein the piston is a hollow structure comprising an air channel and an end face, and the end face comprises a plurality of evenly distributed through holes.

9. An electronic hookah, comprising a tobacco feeding device, a mouthpiece, and a smoke filter, wherein:

the smoke filter comprises a rotating shaft, a third glass tube for water storage, and a fixed seat for fixing the rotating shaft;

the mouthpiece is connected with the third glass tube, the rotating shaft is disposed in the third glass tube and on the fixed seat, and is rotatable with respect to the fixed seat;

the rotating shaft comprises a first hollow columnar part as a second smoke passage, and a second hollow columnar part as a third smoke passage;

the first hollow columnar part is heavier than the second hollow columnar part, and when placed horizontally, the first hollow columnar part is downward and the second hollow columnar part is upward;

the first hollow columnar part and the second hollow columnar part are separate from each other;

the first hollow columnar part comprises a first smoke inlet, and the second hollow columnar part comprises a second smoke inlet;

the tobacco feeding device comprises a fourth glass tube, a push rod, a piston, an assistant push rod, a silicone ring, a cylinder and a press button;

the piston is movable along an inner wall of the glass tube;

the push rod comprises an air passage;

the fourth glass tube comprises a feeding inlet; when the piston moves along the inner wall of the fourth glass tube, a gap between the feeding inlet and the piston is formed, and tobacco material is added to the tobacco feeding device;

the piston is fixedly connected to one end of the push rod;

the assistant push rod sleeves the push rod;

the piston is movable along the inner wall of the fourth glass tube towards the feeding inlet under the action of the assistant push rod;

the silicone ring is disposed between the assistant push rod and the push rod;

the assistant push rod is disposed in the cylinder;

the cylinder comprises a slideway;

the press button is disposed in the slideway and contacts a top end of the assistant push rod; and the movement of the press button in the slideway drives the assistant push rod to move.

10. The electronic hookah of claim 9, the tobacco feeding device further comprises a location pin disposed on the top end of the assistant push rod; and an inner wall of the cylinder comprises a continuous groove matching with the location pin.

11. The electronic hookah of claim 9, wherein the piston is a hollow structure comprising an air channel and an end face, and the end face comprises a plurality of evenly distributed through holes.

12. The electronic hookah of claim 9, wherein the fixed seat comprises an inner air passage, the inner smoke passage communicates with the second smoke passage; the third smoke passage communicates with the mouthpiece.

13. The electronic hookah of claim 9, wherein the smoke filter further comprises a first glass tube, one end of the first glass tube is connected to the first smoke inlet of the first hollow columnar part, and another end of the first glass tube is disposed above an inner bottom surface of the third glass tube.

14. The electronic hookah of claim 9, wherein the smoke filter further comprises a second glass tube; the second glass tube is connected to the second smoke inlet of the second hollow columnar part.

15. The electronic hookah of claim 9, wherein a part of the push rod is disposed in the fixed seat, and communicates with the inner smoke passage of the fixed seat.

* * * * *